US006000347A

United States Patent [19]

Madden, Jr.

[11] Patent Number: 6,000,347

[45] Date of Patent: Dec. 14, 1999

[54] POP-UP BULLET RESISTANT BRIEFCASE APPARATUS

[76] Inventor: James R. Madden, Jr., 2107 E. Chesapeake Rd., Gilbert, Ariz. 85234

[21] Appl. No.: 09/075,883

[22] Filed: May 11, 1998

[51] Int. Cl.[6] ..... E06B 9/00

[52] U.S. Cl. ..... 109/49.5; 109/22

[58] Field of Search ..... 109/22, 23, 49.5, 109/1 S, 11, 12, 5–7

[56] References Cited

U.S. PATENT DOCUMENTS

| | | | |
|---|---|---|---|
| 473,698 | 4/1892 | Fischer | 109/49.5 X |
| 1,438,109 | 12/1922 | Hale | 109/49.5 |
| 1,928,306 | 9/1933 | Brennan | 109/49.5 X |
| 3,745,938 | 7/1973 | Hathaway et al. | 109/49.5 |
| 3,762,345 | 10/1973 | Sgariglia, Jr. | 109/22 |
| 4,412,495 | 11/1983 | Sankar | 109/49.5 |
| 4,546,863 | 10/1985 | Kaufman | 109/49.5 X |
| 4,782,735 | 11/1988 | Mui | 109/22 X |
| 4,919,037 | 4/1990 | Mitchell | 109/49.5 X |
| 5,392,686 | 2/1995 | Sankar | 109/49.5 X |
| 5,413,026 | 5/1995 | Madden, Jr. | 109/49.5 X |

FOREIGN PATENT DOCUMENTS

| | | | |
|---|---|---|---|
| 2192932 | 1/1988 | United Kingdom | 109/49.5 |

*Primary Examiner*—Suzanne Dino Barrett
*Attorney, Agent, or Firm*—H. Gordon Shields

[57] ABSTRACT

Bullet resistant apparatus includes a spring biased panel which extends out one end of the briefcase. The briefcase, with the extended panel, is then rotated ninety degrees to define a bullet resistant shield for a user. The apparatus is made of composite bullet resistant materials and utilizes a compression spring for deployment of a panel disposed within the briefcase. The compression spring is disposed in a pair of telescoping sleeves. The sleeves allow the spring to compress and then to extend to about double its compressed length.

18 Claims, 7 Drawing Sheets

FIG. 12
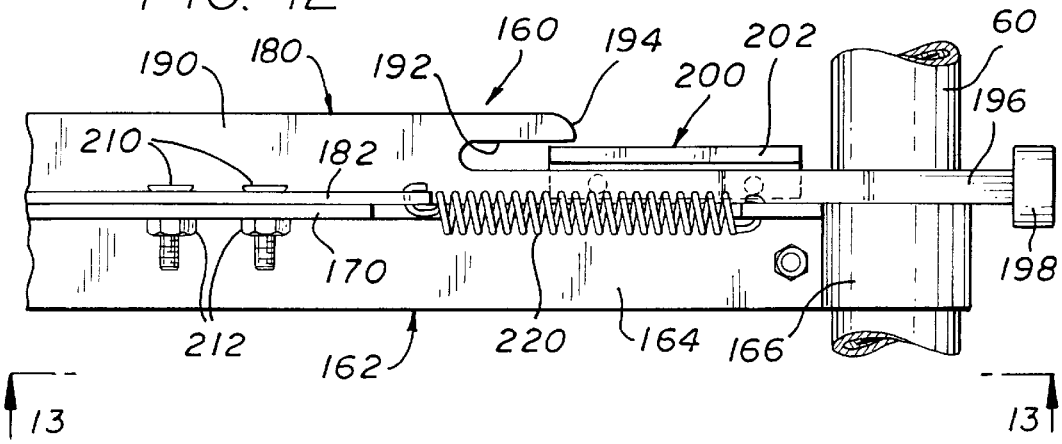
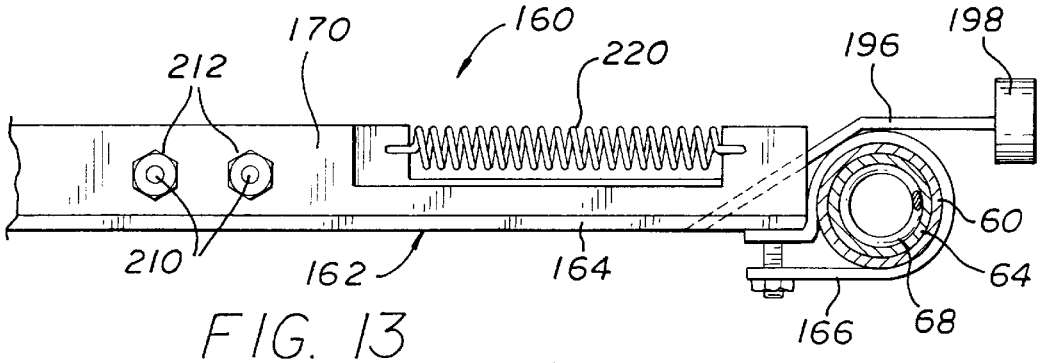
FIG. 13
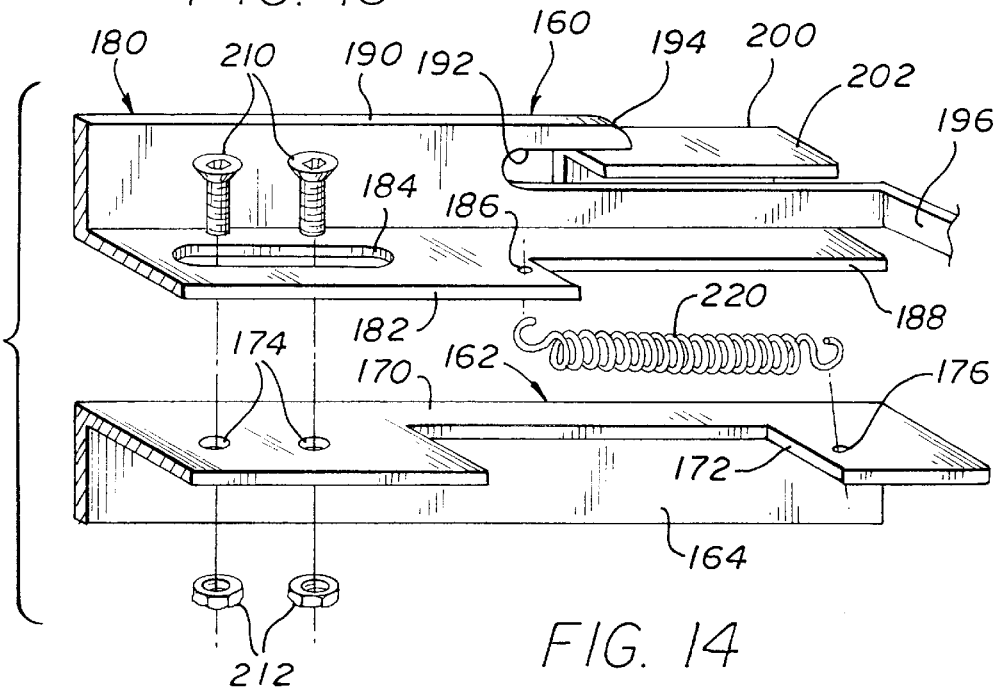
FIG. 14

POP-UP BULLET RESISTANT BRIEFCASE APPARATUS

BACKGROUND OF THE INVENTION

1. Field of the Invention

This invention relates to briefcases and, more particularly, to a bullet resistant briefcase with a bullet resistant pop-up portion for use as a body shield.

2. Description of the Prior Art

U.S. Pat. No. 3,762,345 (Sgariglia, Jr.) discloses a briefcase with a plurality of shield elements, some of which pop up and some of which extend downwardly be gravity to provide a shield. A pair of springs bias a shield portion upwardly while a pair of shield extensions move downwardly by gravity.

U.S. Pat. No. 4,546,863 (Kaufman) discloses another attache case which comprises a protective shield. The case includes a removable portion which, when removed, reveals a pair of straps held by a user to employ the remaining portion of the attache case as a shield.

U.S. Pat. No. 4,782,735 (Mui et al) discloses an inflatable body shield which may be transported in a briefcase or attache case. Within the case is a source of pressurized gas for inflating the body shield. A second embodiment is disclosed in which the apparatus is transported as a backpack.

U.S. Pat. No. 4,919,037 (Mitchell) discloses a clipboard which may be used as a ballistic shield. The clipboard includes a writings surface and a strap for holding the clipboard apparatus as a shield.

U.S. Pat. No. 5,392,686 (Sankar) discloses a telescoping protective shield which expands from a relatively small or compact unit to a body shield by lowering any of a plurality of panel elements. The apparatus includes a viewing window. The panel elements may be deployed downwardly to accommodate users of different sizes.

It will be noted that the '345 and the '863 patents, both of which begin as attache cases, the full width of the case is used as a shield, with elements extending upwardly and downwardly from the '345 apparatus and the case itself being used as a shield in the '863 apparatus.

The '345 patent utilizes gravity as well as a pair of tension springs for activation, and the '863 apparatus is strictly a hand held unit with no extra panels. The '735 apparatus utilizes pressurized gas, and the '037 apparatus is essentially a one element shield. The '686 apparatus is a telescoping shield with elements gravity actuated.

The apparatus of the present invention includes a pop-up panel disposed within the briefcase. The panel extends from an end of the briefcase, allowing nearly double the length of the briefcase to be used as a shield.

SUMMARY OF THE INVENTION

The invention described and claimed herein comprises a briefcase or attache case, or the like, in which is disposed a movable bullet resistant panel that, together with a bullet resistant back panel in the case, comprises a bullet resistant shield for a user. The attached case or briefcase is functional for carrying objects, as is typical with such elements, but includes a extendible panel. The extendible panel moves under spring bias in telescoping sleeves to its open configuration and may lock in place.

Among the objects of the present invention are the following:

To provide new and useful bullet resistant briefcase apparatus;

To provide new and useful bullet resistant briefcase apparatus having an extendible bullet resistant panel.

To provide new and useful bullet resistant apparatus having a spring biased panel;

To provide new and useful personal bullet resistant apparatus which is easily carried and held; and To provide new and useful bullet resistant apparatus configured as a briefcase and having bullet resistant panels made of composite material.

BRIEF DESCRIPTION OF THE DRAWING

FIG. 12 is an enlarged view in partial section of a portion of the apparatus of FIG. 11.

FIG. 13 is a view taken generally along line 113-13 of FIG. 12.

FIG. 14 is an exploded perspective view of the apparatus of FIGS. 12 and 13.

DESCRIPTION OF THE PREFERRED EMBODIMENT

Figure 1:
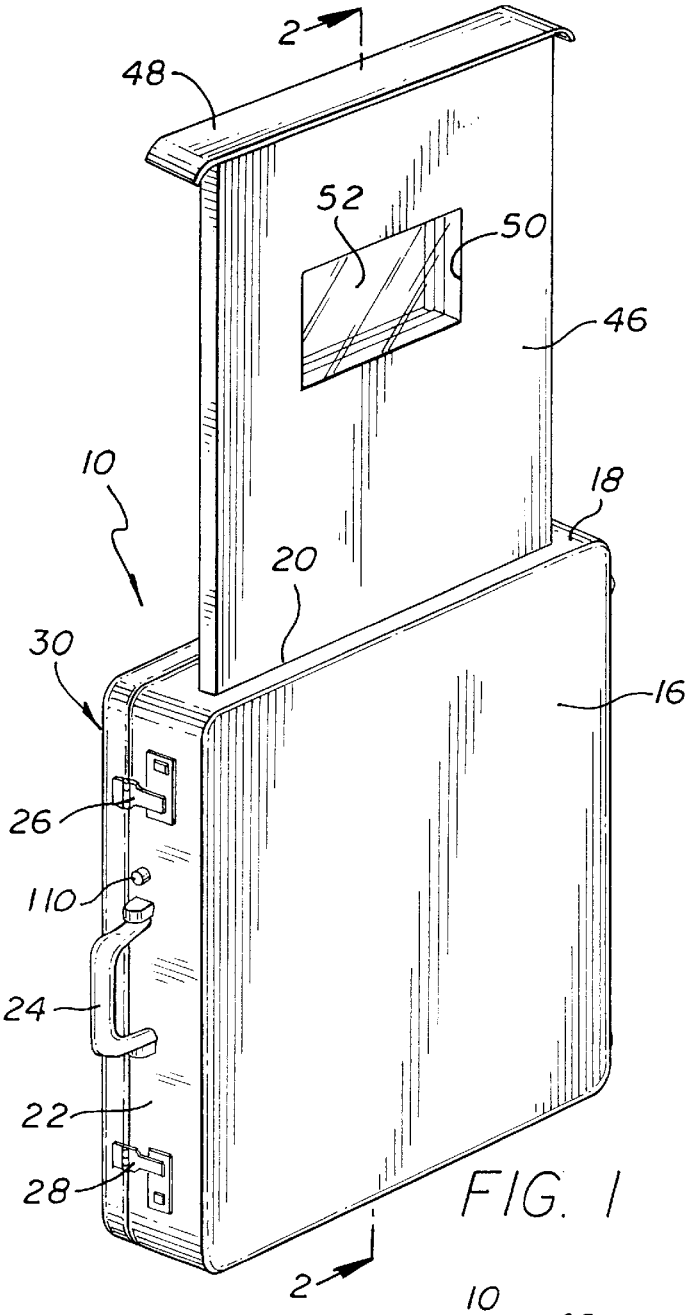
FIG. 1 is a perspective view of the apparatus of the present invention in its use condition or status.
Figure 2:
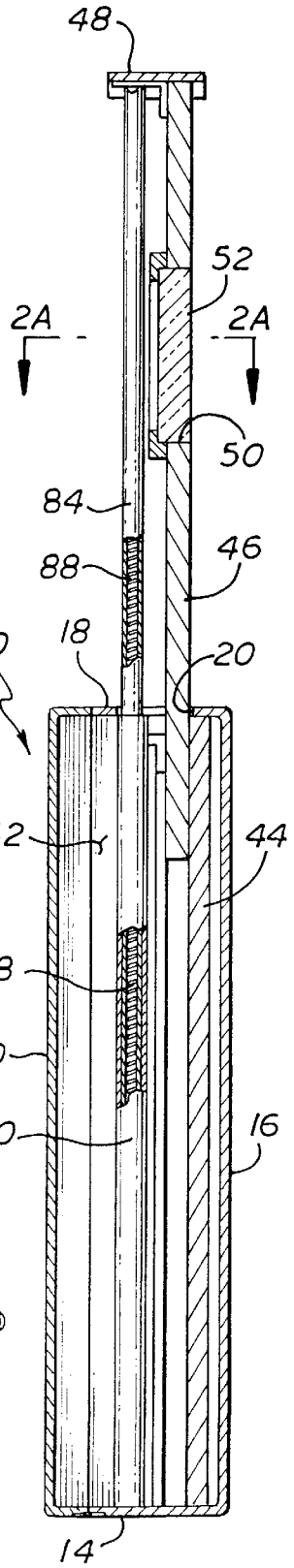
FIG. 2 is a side view in partial section taken generally along line 2—2 of FIG. 1.
Figure 2A:
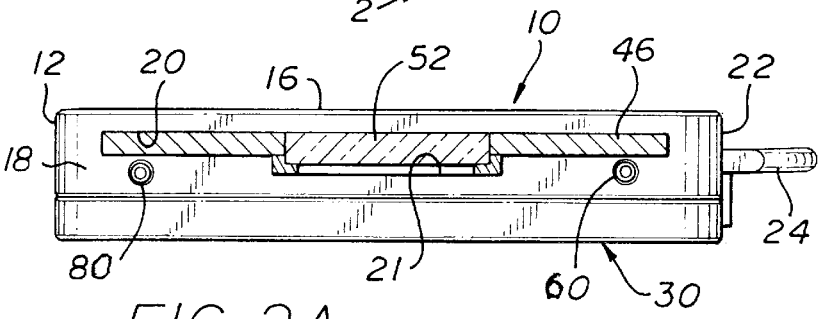
FIG. 2A is a view in partial section taken generally along line 2A—2A of FIG. 2.
Figure 3:
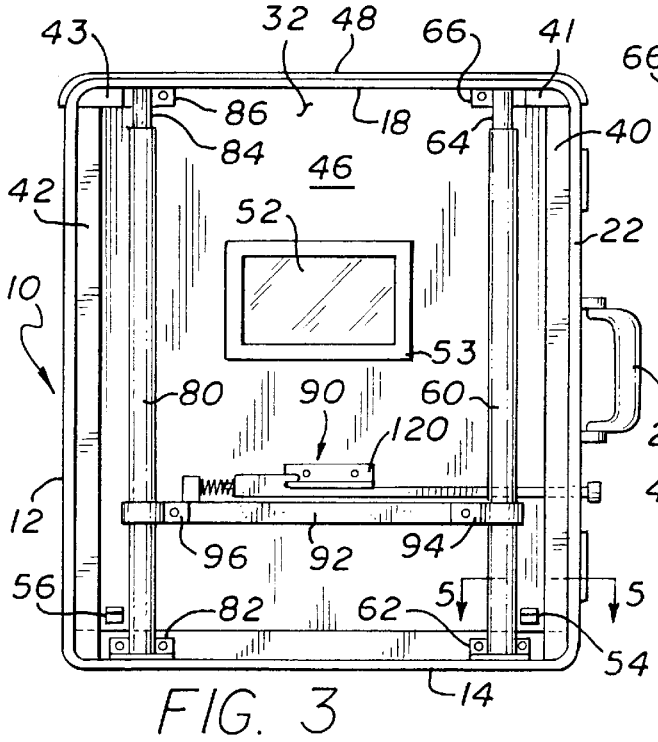
FIG. 3 is a plan view of the apparatus of the present invention with a front cover removed.

FIG. 1 is a perspective view of bullet resistant briefcase apparatus 10 of the present invention illustrating the apparatus 10 in its use condition or state, with a shield portion deployed. FIG. 2 is a side view in partial section of the briefcase apparatus 10 taken generally along line 2—2 of FIG. 1. FIG. 2A is a view taken along line 2A—2A of FIG. 2 and comprising a view in partial section looking downwardly through a portion of the apparatus 10. FIG. 3 is a plan view of a portion of the apparatus 10 illustrating elements disposed therein.

For the following discussion reference will primarily be made to FIGS. 1, 2, 2A, and 3.

For the following general descriptive nomenclature of the briefcase 10, the briefcase in its normal configuration or usage will be employed. Thus, a bullet resistant panel moves outwardly or is deployed through an end wall of the briefcase. However, when the bullet resistant panel is deployed, the briefcase is rotated ninety degrees to use the briefcase as a shield. Thus, what was the end wall through which the bullet resistant panel moved now becomes a top wall as the bullet resistant panel moves "up" as it is deployed.

Briefcase apparatus 10 includes a bottom wall 12, a lower end wall 14, a side wall 16, and an upper end wall 18. The upper end wall 18 includes a cutout 20 through which a movable bullet resistant panel 46 moves. The briefcase apparatus 10 also includes a top wall 22 to which is secured a handle 24. The briefcase apparatus 10 is closed by a cover 30. The cover 30 is appropriately pivotally secured to the bottom wall 12 in a well known manner. The cover is also secured to the top wall 22 by appropriate cooperating latches elements 26 and 28.

Within the briefcase apparatus 10, beneath the cover 30, is a compartment 32 and within the compartment 32 are various elements associated with the movable bullet resistant panel 46. Disposed against the front side wall 16 is a fixed bullet resistant panel 44. A pair of guide channels 40 and 42 may be secured to the bottom wall 12. The panels 44 and 46 are disposed within the guide channels 40 and 42. The movable panel 46 moves in the guide channels 40 and 42 upwardly or outwardly through the upper end wall 18 and through the cutout or slot 20 therein.

An end wall panel 48 is appropriately secured to the top of the movable bullet resistant panel 46. When the panel 46 is in its down position, as best shown in FIG. 3, the end wall panel 48 blends in with the end wall 18 and may be disposed in a recess thereof, to blend in with the rest of the briefcase apparatus 10. Thus, from all exterior appearances, with the movable panel 46 in its down position, the briefcase 10 appears to be a normal, inconspicuous, briefcase used by many persons in everyday life.

Both bullet resistant panels 44 and 46 are preferably made of appropriate composite materials. The thickness or weight of the panels is determined by practicality and by the degree of protection desired.

A cutout 50 extends through the movable panel 46 and a transparent bullet resistant panel 52 is appropriately disposed therein and secured to the panel 46 by an appropriate bracket 53.

The cutout 20 may be used as a hand hold for the apparatus 10 when the panel 46 is in its deployed condition. This may be best understood from FIG. 2A. The configuration of the cutout 20 is generally rectangular, but may include an offset area or portion 21 through which the transparent panel 52 and its bracket 53 extend. The offset portion 21 may comprise a hand hold area or safe handle portion for a user of the apparatus.

Referring specifically to FIG. 2, which shows the panel 46 fully deployed, an overlap area of the two panels 44 and 46 is shown. This overlap area provides extra or complete protection in an otherwise critical area.

A stop bracket 54 is appropriately secured to the lower portion of panel 46 to act as a stop when the panel 46 is in its uppermost deployed position, as shown in FIGS. 1 and 2. The bracket 54 contacts a stop element 41 secured to the channel 40. A second stop bracket 56 is secured to the lower portion of the movable panel 46 spaced apart from and aligned with the bracket 54. The bracket 56 contacts a stop element 43 secured to the channel 42 when the panel 46 is in its outer or extended position.

The brackets 54 and 56 may be simple "L" shaped angle brackets, one arm of which is secured to the panel 46 and the other arm of which extends outwardly to contact a stop element. Bumper elements, dampening shock absorbers, etc., may be used, as desired, in place of the brackets 54 and 56.

Figure 6:
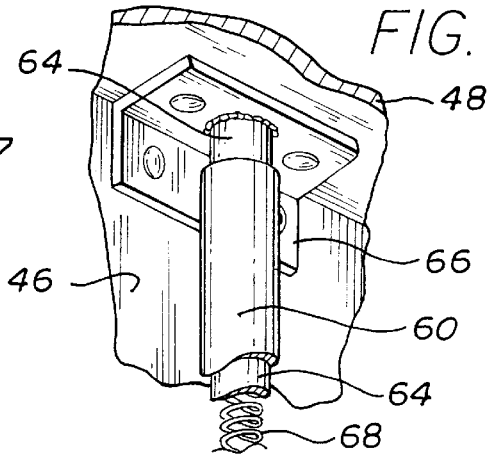
FIG. 6 is a perspective view, partially broken away, illustrating some of the structure of the apparatus of the present invention.

The stop elements 41 and 43 are disposed adjacent to the wall 18, as best shown in FIGS. 3 and 6, to limit the upward movement of the panel 46.

A pair of sleeves or cylinders 60 and 80 are secured to the end wall 14 by a pair of brackets 62 and 82, respectively. Within the sleeves 60 and 80 are inner sleeves or cylinders 64 and 84, respectively. The sleeves or cylinders 64 and 84 are secured to the movable panel 46 and to the end wall panel 48 by a pair of brackets 66 and 86, respectively. Within the sleeve pairs 60, 64 and 80, 84 are a pair of compression springs 68 and 88, respectively. Details of the sleeves or cylinder pairs and their associated brackets and springs are illustrated in FIGS. 4 and 5.

Figure 4:
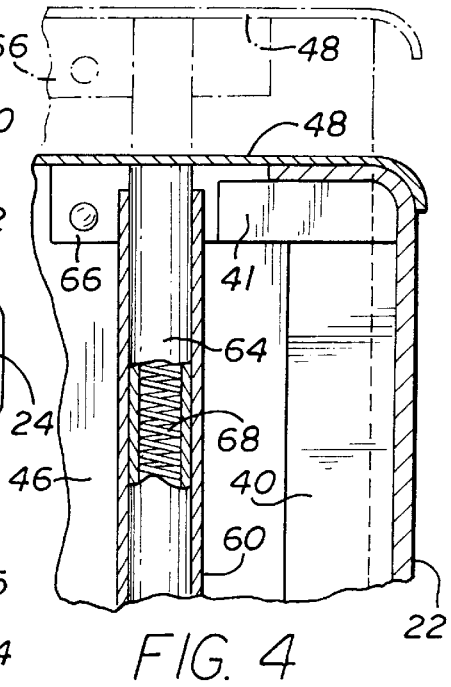
FIG. 4 is an enlarged view in partial section illustrating the operation of a portion of the apparatus of the present invention.
Figure 5:
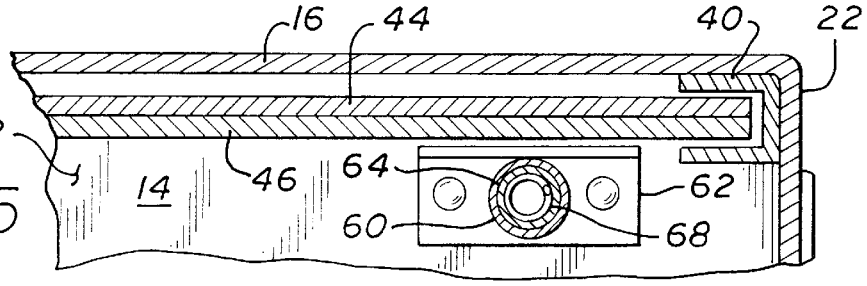
FIG. 5 is an enlarged view in partial section taken generally along line 5—5 of FIG. 3.

FIG. 4 is a view in partial section showing the sleeve 60, which terminates adjacent to the end wall panel 48, and the inner sleeve 64 and the spring 68 disposed within the outer sleeve or cylinder 60. The inner sleeve 64 is shown secured to the end wall panel 48 by the bracket 66. The bracket 66 comprises an upper support through which the inner sleeve 64 is secured to the end wall panel 48 and to the movable panel 46.

If an end panel, such as the end panel 48, is not used, then, of course, the inner sleeves are only secured to the movable panel 46 by the brackets 66 and 86.

Also shown in FIG. 4 is a portion of the channel 40 and the stop element 41 secured thereto adjacent to the end wall panel 48.

FIG. 5 is a view in partial section of a portion of the apparatus 10, including the end wall 14, side wall 16, and the top wall 22. Also shown in FIG. 5 is the bracket 62 for the cylinder or sleeve 60 and the spring 68 disposed in the sleeve 60. The channel 40 is shown in FIG. 5, together with the fixed bullet resistant panel 44 and the movable bullet resistant panel 46, both of which are nested or disposed within the channel 40.

FIG. 6 comprises a perspective view showing the bracket 66 secured to both the panel 46 and the end wall panel 48 and also secured to the inner sleeve 64. Portions of the outer sleeve 60 and the compression spring 68 are also shown in FIG. 6.

Figure 7:
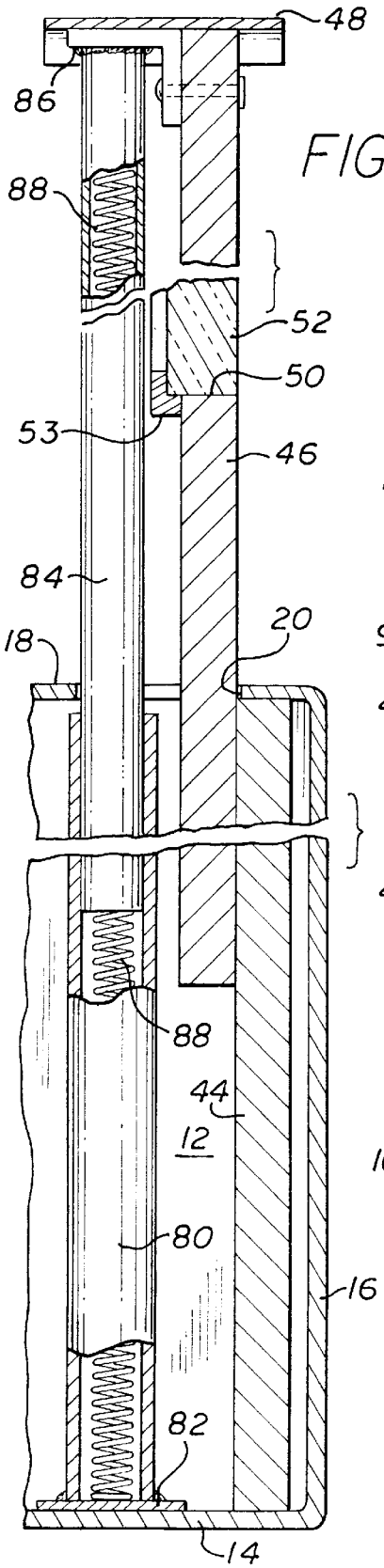
FIG. 7 is a side view in partial section illustrating various elements of the apparatus of the present invention.

FIG. 7 comprises a view in partial section through the briefcase apparatus 10 and specifically through the lower end wall 14, the side wall 16, and the upper end wall 18. The cutout 20 through the upper end wall 18 is also shown, with the panel 46 extending upwardly through the cutout 20. The cylinder or sleeve 84 is shown extending through the cutout 20. The compression spring 88 is shown disposed within the cylinders or sleeves 80 and 84 and extending between the support brackets 82 and 86.

The upper support 86 for the sleeve 84 is also shown in FIG. 8. The support bracket 86 is shown secured to both the end wall panel 48 and the movable panel 46.

The telescoping sleeve or cylinder pairs 60, 64 and 80, 84 allow the compression springs 68 and 88 to extend from their compressed state when the panel 46 is in its nested or closed condition, such as shown in FIG. 3. When the panel 46 is fully deployed, the springs may substantially double their compressed lengths.

It will also be noted that the sleeves or cylinders 60 and 80 are only fixedly secured to their lower ends and are floating at their outer ends. This arrangement prevents any binding of the sleeves 64 and 84 as the panel 46 is deployed under the bias of the springs 68 and 88.

It will also be noted that under some circumstances, only a single compression spring may be needed to deploy the panel 46.

Figure 8A:
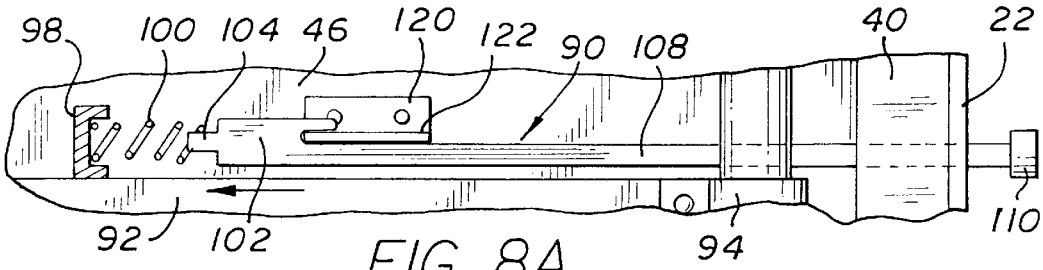
FIG. 8A is an enlarged view in partial section of a portion of the apparatus of FIG. 3.
Figure 8B:
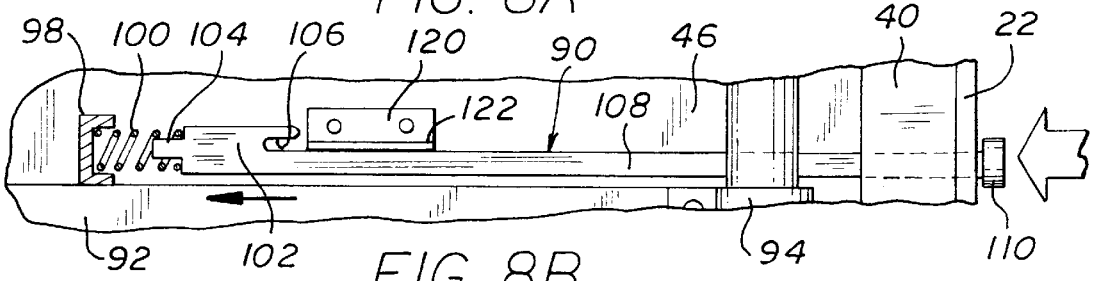
FIG. 8B is a sequential view following FIG. 4A illustrating the functioning of the apparatus illustrated therein.

A release or actuating assembly 90 is illustrated in FIGS. 8A and 8B. FIG. 8A is an enlarged view, partially broken away, showing the release mechanism in the locked configuration, and FIG. 8B sequentially illustrates the release assembly 90 in the unlocked or unlatched configurations, which allows the movable panel 46 to move upwardly under the bias of the spring 68, as discussed above. For the following discussion, reference will primarily be made to FIGS. 8A and 8B. The release assembly 90 is also shown in FIG. 3, appropriately secured to the guide tube 60 and 64.

The release assembly 90 includes a bracket 92 secured to the sleeves 60 and 80 by a pair of clamps 94 and 96, respectively. A cup or spring holder 98 is appropriately secured to the bracket 92. A compression spring 100 extends between the cup 98 and a latch 102. The latch 102 includes a pin 104 which extends into the spring 100, and a recess 106 which receives an arm 122 of a latch bracket 120 to secure the panel 46 in the down, or closed (nested) position. The latch bracket 120 is appropriately secured to the panel 46. The latch bracket 120 is shown as an angle bracket in which one arm is secured to the panel 46 and the other arm extends outwardly and cooperates with the recess 106 in the latch element 102 for locking or latching the panel 46 within the compartment 32.

Extending outwardly from the latch 102 is an extension rod 108. The rod 108 extends through the top wall 22 and terminates in a release button 110. The button 110 is disposed convenient to the handle 24 such that appropriate pressure by a user's thumb or finger moves the latch against the bias of the spring 100 to disengage the arm 122 from the recess 106. The panel 46 will then move upwardly or outwardly under the bias of the spring 68. Thus deployed, the movable bullet resistant panel 44 and the fixed bullet resistant panel 46 comprise a shield to protect a user from bullets fired toward the user of the briefcase apparatus 10. The user may view the assailant through the transparent bullet resistant panel 52 in the movable panel 46. As soon as the panel 46 is deployed, the area 21 may be used as an auxiliary hand hold, as discussed above.

While the panel 46 may be held in its outward or deployed position by the compression spring or springs used to deploy the panel, under some circumstances a lock assembly, such as a lock assembly 130, may be used.

Figure 9A:
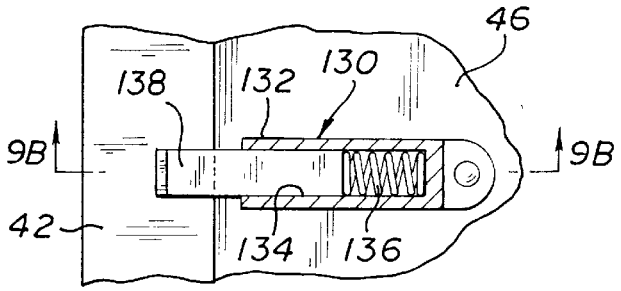
FIG. 9A is an enlarged view in partial section illustrating a portion of the apparatus of the present invention.
Figure 9B:
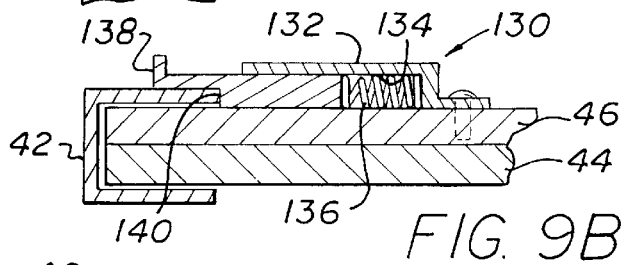
FIG. 9B is a view in partial section taken generally along line 9B—9B of FIG. 9A.
Figure 10A:
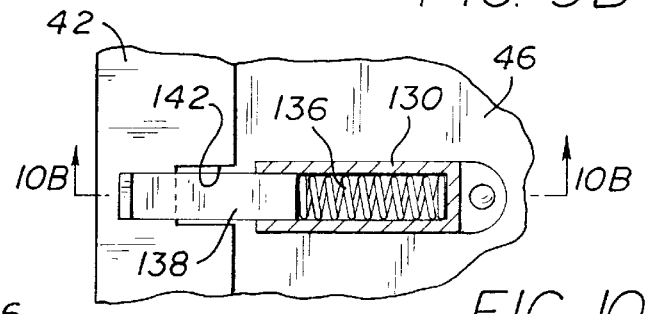
FIG. 10A is a view in partial section illustrating the elements of FIG. 9A in a lock position.
Figure 10B:
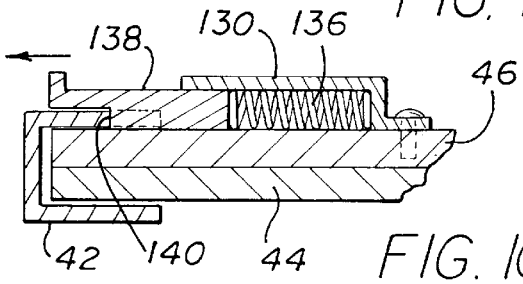
FIG. 10B is a view in partial section taken generally along line 10B—10B of FIG. 10A.

The lock assembly 130 is illustrated in FIGS. 9A and 9B, and 10A and 10B. In FIG. 9A, the lock assembly 130 is shown in the unlatched or unlocked position, as when the movable panel 46 is in the down, or closed position, as illustrated in FIGS. 3 and 6. FIG. 9B is a view in partial section taken generally along line 9B—9B of FIG. 9A. FIG. 10A is an enlarged view in partial section illustrating the employment of the lock assembly 130 when the panel 46 is in the up, deployed orientation, as illustrated in FIGS. 1, 2, and 7. FIG. 10B is a view in partial section taken generally along line 10A–10B of FIG. 10A. For the following discussion, reference will primarily be made to FIGS. 9A, 9B, 10A, and 10B.

The lock assembly 130 includes a retainer element 132 appropriately secured to the movable panel 46. The retainer 132 includes a bore 134 in which there is disposed a compression spring 136 and a lock element 138. The lock element 138 includes a bottom shoulder 140 which receives a portion of the guide channel 42, as best shown in FIG. 9B.

The compression spring 136 biases the lock element 138 outwardly with the shoulder 140 disposed against the guide channel 142 and an outer portion of the lock element 138 disposed on the channel 42.

As the panel 46 moves upwardly or outwardly as it is deployed, the lock assembly 130 moves with it. In the guide channel 42 there is a recess or notch 142. As the lock element 138 moves upwardly, and under the constant outward bias of the spring 136, the lock element 138 moves into the notch 142 when the lock element 138 is appropriately aligned with the notch 142. This alignment occurs when the panel 46 is deployed in its uppermost or outermost, deployed, orientation, as illustrated in FIGS. 1, 2, and 8. This also occurs when the stop brackets 54 and 56 are disposed against the stop tabs 41 and 43, respectively.

When the lock element 138 moves into the notch 142, the panel 46 is essentially locked into position. There must be a positive release of the lock assembly 130 to move the lock element 138 out of the notch 142 in order to allow the panel 46 to be moved downwardly to its undeployed orientation as illustrated in FIGS. 3 and 6.

While only a single lock assembly 130 for the guide channel 42 is illustrated in FIGS. 9A. 9B, 10A, and 10B, it is obvious that a second lock assembly should be employed for the guide channel 40.

Figure 11:
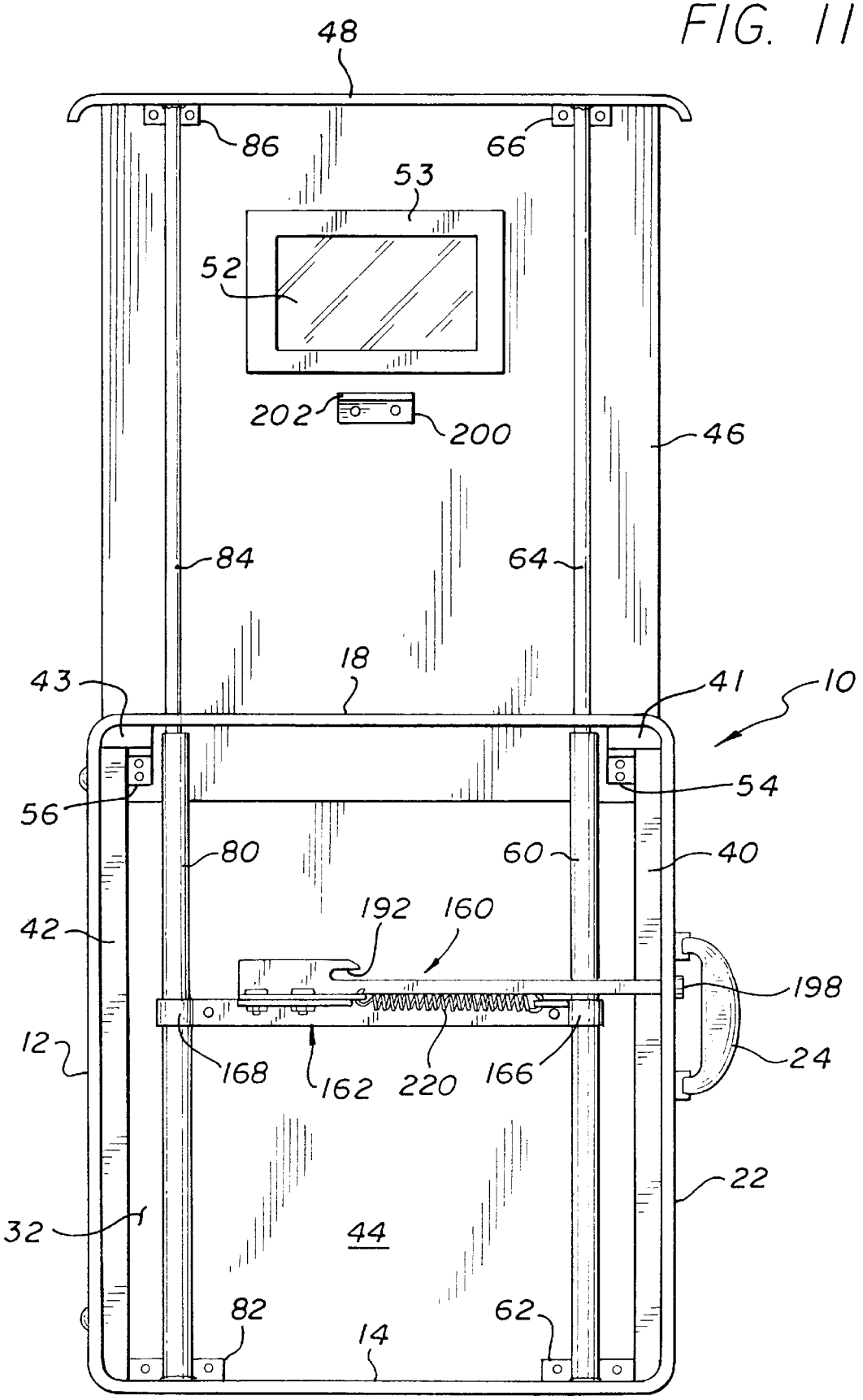
FIG. 11 is a plan view of an alternate embodiment of the apparatus illustrated in FIG. 3.

An alternate embodiment of the release assembly 90 illustrated in FIGS. 3, 8A, and 8B, is shown in FIG. 11. FIG. 11 comprises a plan view of the briefcase apparatus 10 showing the panel 46 in its outer or deployed orientation, and employing a release assembly 160. The elements of the briefcase assembly 10 are illustrated, with the bottom wall 12, end walls 14 and 18, and the top wall 22 shown. The handle 24 is shown appropriately secured to the top wall 22.

The fixed panel 44 is also shown in FIG. 11.

The panel 46 moves upwardly under the bias of the compression spring or springs, not shown in FIG. 11, disposed in the telescoping sleeve pairs 60,64 and 80, 84. The sleeves 60 and 80, with their bottom support brackets 62 and 82, are shown in FIG. 11. The sleeves 64 and 84 which are disposed in and guided by the sleeves 60 and 80, are shown in FIG. 11 secured to the movable panel 46 and the end wall panel 48 by their support brackets 66 and 86, respectively. The transparent bullet resistant panel 52 in the panel 46 is also shown in FIG. 11.

The stop brackets 54 and 56, secured to the panel 46 adjacent to its bottom, are shown in FIG. 11 disposed against the stop tabs 41 and 43, respectively.

The release assembly 160 includes a bracket 162 secured to the sleeves 60 and 80 by a pair of clamp elements 166 and 168, respectively. The bracket 162 may be an angle bracket type element with a pair of generally perpendicular arms, including an arm 164 and an arm 170. The arm 164 is appropriately secured to the sleeves 60 and 80 by the pair of clamps 166 and 168, respectively. Disposed on the bracket 162 is a release slide 180. Details of the release assembly 160, including the bracket 162 and the release slide 180, are shown in FIGS. 12, 13, and 14. FIG. 12 is an enlarged view of a portion of the release assembly 160, and FIG. 13 is a bottom view of the elements of FIG. 12 taken generally along line 13—13 of FIG. 12. FIG. 14 is an exploded perspective view, partially broken away, of the release assembly 180, with the bracket 162 and the release slide 180 spaced apart from each other. For the following discussion, reference will be made to FIGS. 11, 12, 13, and 14.

The arm 170 extends outwardly substantially perpendicularly to the arm 164. The aim 170 includes a relieved area 172 and a number of holes or apertures, including a pair of tapped apertures or holes 174 and a spring aperture or hole 176.

Disposed on the arm 170 of the bracket 162 is the release slide 180. The release slide 180 includes a pair of arms 182 and 190. The arms 182 and 190 are similarly disposed substantially ninety degrees to each other. The arm 182 is disposed on the arm 170 and moves thereon.

The arm 182 includes a slot 184 and an aperture or hole 186. The arm 182 also includes a cutout or relieved portion 188. The cutout or relieved portion 188 corresponds generally to the relieved area 172 in the arm 170 of the bracket 162.

The arm 190 is a latch arm and it includes a slot 192 for receiving an arm 202 of a latch bracket 200. The latch bracket 200 is appropriately secured to the panel 46. The latch arm 190 also includes a cam edge 194 at the slot 192. The purpose of the cam edge 194 is to cam the release slide 180 away from the arm 202 of the lock bracket as the panel 46 is pushed downwardly to cause the panel 46 to nest within the main body of the briefcase 10, adjacent to the fixed panel 44. Thus, as the panel 46 is pushed downwardly, the bottom of the arm 202 contacts the cam edge 194 and causes the release slide 180 to move to the left as shown in FIGS. 11, 12, 13, and 14. As the latch arm 202 of the bracket 200 moves downwardly, it moves into the slot 192 to lock the panel 46 downwardly in the closed or nested position.

Extending outwardly from the latch arm 190 is an extension arm 196. The extension arm 196 curves, as may best be understood from FIG. 13, to move around the clamp 166 and the guide tube 60. The extension arm 196 continues outwardly through the top wall 22, through an appropriate aperture or hole therein, and terminates in a release button 198.

As shown in FIG. 11, the release button 198 is disposed adjacent to the handle 24 to allow a user of the apparatus 10 to deploy the panel 46 by merely pressing on the release button 198 with a thumb or finger, all as discussed above in conjunction with the release button 110 for the embodiment discussed specifically in conjunction with FIGS. 3, 8A, and 8B.

The release slide 180 is appropriately slidingly secured to the bracket 162 by means of a pair of screws 210 which extend through the slot 184 and into the apertures 174. The apertures 174 are preferably tapped to receive the threaded shanks of the screws 210. For locking the screws 210 in place relative to the arm 170, a pair of nuts 212 are used. The nuts 212 are tightened on the shanks of the screws 210 beneath the arm 170.

The screws 210 allow relative movement between the bracket 162 and the release slide 180, with the release slide 180 moving longitudinally on the bracket 162.

A tension spring 220 extends between the spring aperture 176 and the arm 170 and the spring aperture 186 in the arm 182. The tension spring urges the release slide 180 to the right as shown in FIGS. 11, 12, 13, and 14, to hold the arm 202 of the bracket 220 in the slot 192 of the arm 190 of the release slide 180.

Figure 15:
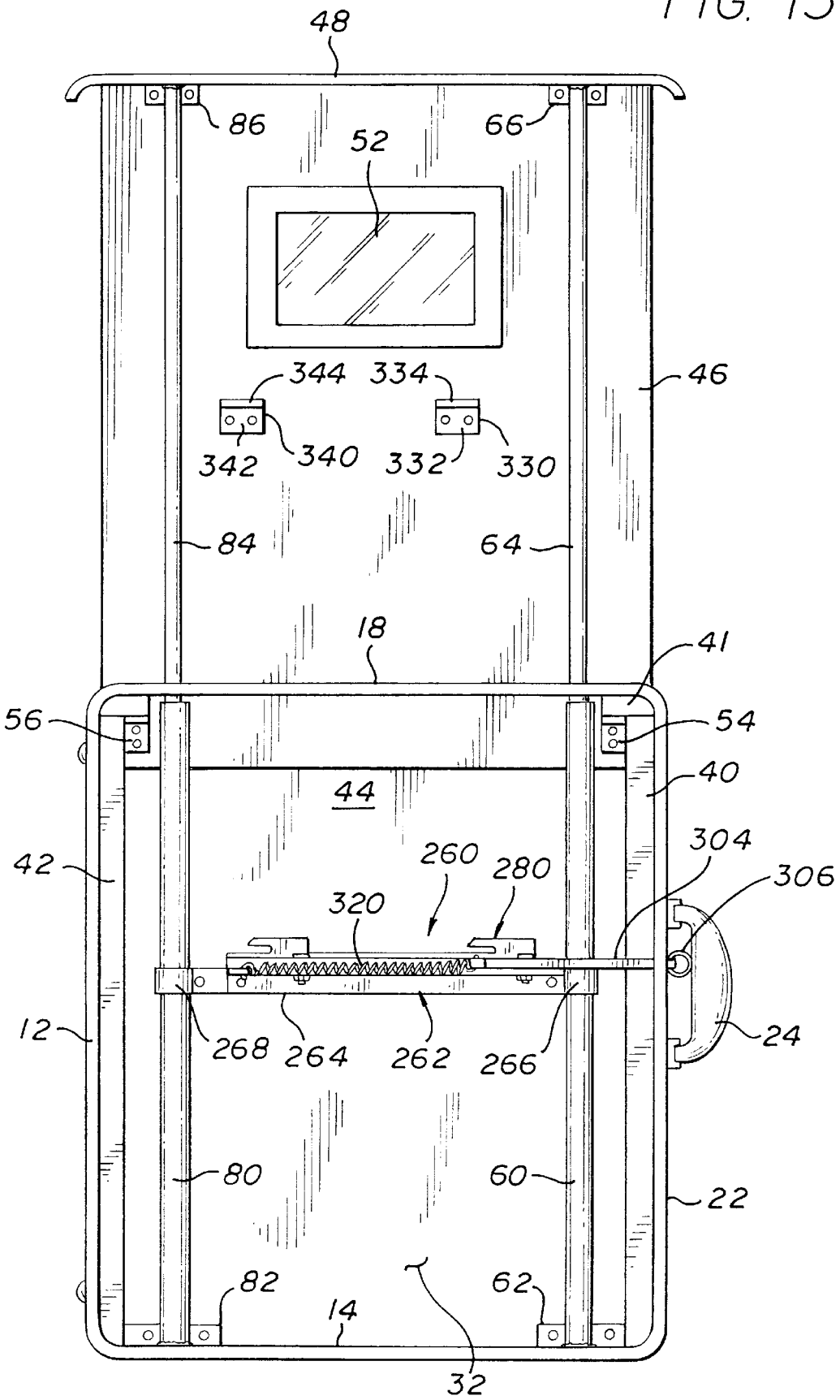
FIG. 15 is an plan view of another alternate embodiment of the apparatus of the present invention.
Figure 16:
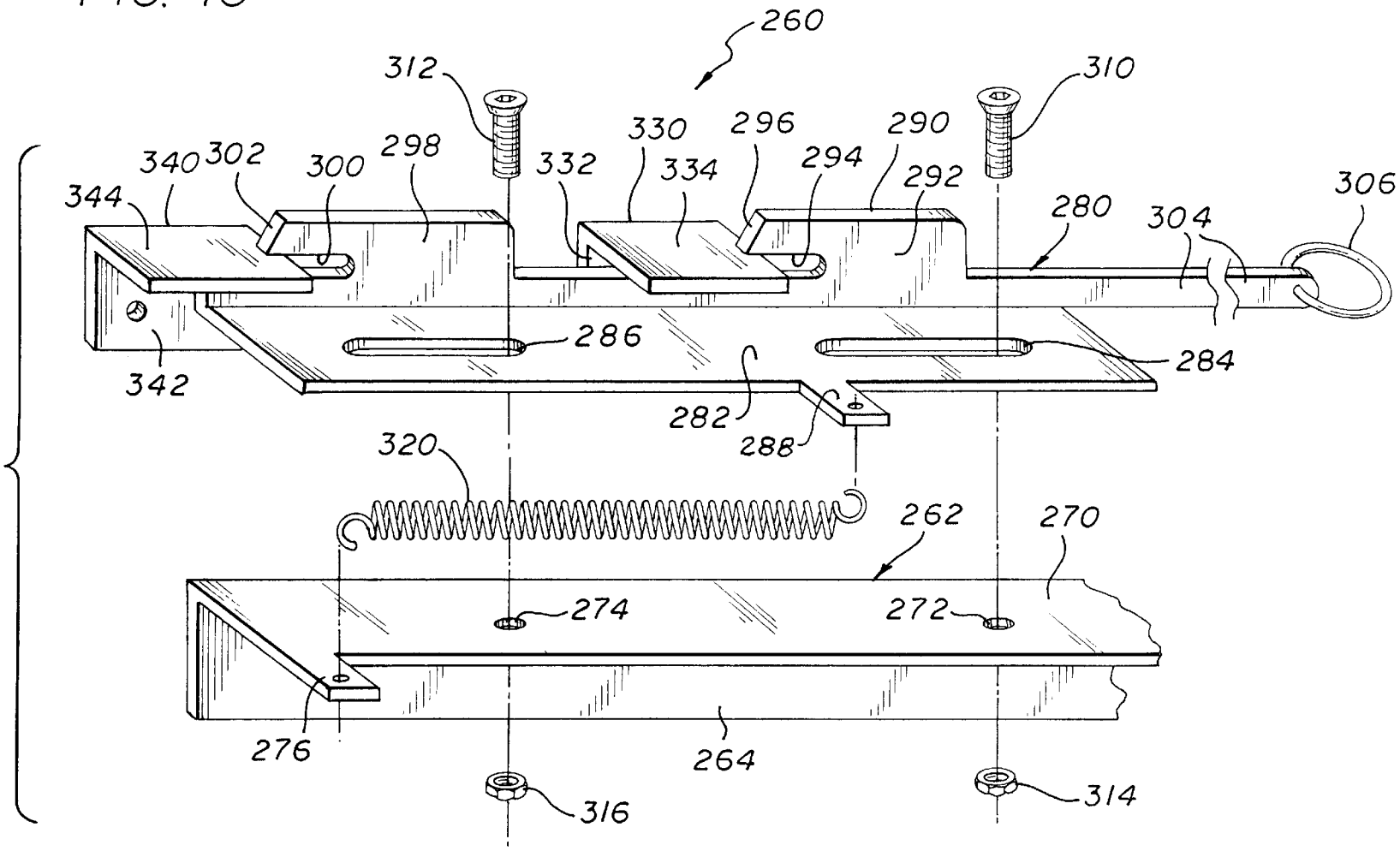
FIG. 16 is an exploded perspective view of a portion of the apparatus of FIG. 15.

Another alternate embodiment of a release system is illustrated in FIG. 15 and 16 in which a release assembly 260 is employed.

FIG. 15 is a front view of the apparatus 10 with the general elements identified above, namely a bottom wall 12, a lower end wall 14, an upper end wall 18, a top wall 22, with a handle 24 secured thereto. Within the briefcase apparatus 10 is the fixed bullet resistant panel 44, and the movable bullet resistant panel 46 is shown in its deployed or open position, extending outwardly through an aperture in the end wall 18.

The movable panel 46 is appropriately secured to the end wall panel 48 and to the sleeves 64 and 84 through the respective brackets 66 and 86. The panel 46 moves in the guide channel elements 40 and 42. At the upper end of the guide channels 40 and 42 are the stop tabs 41 and 43, respectively. The upward movement of the panel 46 is stopped by the brackets 54 and 56 contacting the stop elements 41 and 43, respectively.

FIG. 16 is an exploded perspective view of a portion of the release assembly 260. For the following discussion, reference will be made to both FIGS. 15 and 16.

The release assembly 260 includes a bracket 262 which includes an arm 264 appropriately secured to the sleeves 60 and 80 by a pair of clamps 266 and 268, respectively. The bracket 262 includes an arm 270 which is generally perpendicular to the arm 264. A pair of aligned and tapped holes or apertures 272 and 274 extend through the arm 270.

The arm 270 extends generally the full distance between the sleeves 60 and 80 and a release slide 280 is movably or slidably disposed on the arm 270.

The release slide 280 includes a pair of arms 282 and 290 which are generally perpendicular to each other, as discussed above. The release slide 280 includes the generally horizontally extending arm 282 which is disposed on the arm 270 of the bracket 262. The arm 282 is similar to the arm 182, as discussed above, except that a pair of slots 284 and 286 extend through the arm 282 and a pair of screws 310 and 312 extend respectively through the slots 284 and 486 to hold the release slide 280 to the bracket 262. The screws extend through the slots 284 and 286 in a manner similar to that of the screws 210 in the slot 184, as illustrated in FIGS. 12, 13, and 14. However, with respect to the release slide 280, only one screw extends through each of the slots.

A pair of nuts 314 and 316 are used to lock the screws 310 and 312, respectively, to the arm 270.

The release slide 280 also includes the latch arm 290 which extends upwardly from the arm 282. On the latch arm 290 are latch elements 292 and 298. The latch element 292 includes a slot 294, a cam edge 296 extends upwardly from the slot 294 and at an angle relative to the outer edge of the slot 294. The latch element 298 is substantially identical to the latch element 292. It includes a slot 300 and a cam edge 302 adjacent to the slot 300.

An extension arm 304 extends outwardly from the arm 290 and is appropriately curved to extend about the sleeve 60. The extension arm 304 extends through the wall 22 adjacent to the handle 24. A ring 306 is disposed on the outer end of the extension arm 304 at the handle 24.

A tension spring 320 extends between a tab 276 on the arm 270 and a tab 288 on the arm 282 of the release slide 280. The tabs 276 and 288 include holes or apertures to receive the ends of the tension spring 320. The tension spring 320 holds the release slide 280 in the locked position, and opposes a pull on the ring 306 by a user of the briefcase apparatus 10.

It will be noted that the release assembly 260 has the release slide 280 disposed in an opposite bias, or the reverse, of the release slide 180 of FIGS. 11, 12, 13, and 14.

A pair of latch brackets 330 and 340 are appropriately secured to the panel 46. For convenience in understanding the operation of the release assembly 260, the latch brackets 330 and 340 are also shown in FIG. 16.

The latch bracket 330 includes an arm 332 disposed against the panel 46 and a latch arm 334 extending outwardly substantially perpendicularly to the arm 332. The arm 334 extends into the slot 294. The bracket 340 is substantially identical to the bracket 330, and includes a pair of arms, with an arm 342 fastened to the panel 46 and a latch arm 344. The latch arm 344 extends into the slot 300.

When the panel 46 is in its down, or nested position, undeployed, within the body of the briefcase 10, the arm portion 334 extends into the slot 294 and the arm portion 338 is disposed in the slot 300 to secure the panel 46 in the nested position.

The release assembly 260 operates in the opposite manner from the release assemblies discussed above in that the ring 306 must be pulled to move the release slide 280 away from engagement with the arm portions of the lock brackets 330 and 340. When the release slide is moved out of engagement with the latch arm portions of the latch brackets 330 and 340, the panel 46 moves upwardly under the bias of the spring(s) in the telescoping cylinder(s) (see FIG. 7), as discussed above for the other embodiments.

To move the panel 46 back into its nested position within the body of the briefcase apparatus 10, the panel 46 is pushed downwardly or inwardly and when the arm portions 334 and 344 contact the cam edges 296 and 302, the release side 280 is cammed to the right, as shown in FIG. 15, until the arm portions 334 and 344 move into the slots 294 and 300, respectively. With the arm portions 334 and 344 disposed within the respective slots, the panel 46 is locked in its undeployed, or nested, position within the body of the briefcase apparatus 10.

Several different embodiments are illustrated in the drawing Figures are discussed above in conjunction therewith. Fundamentally, all of the embodiments utilize at least a single compression spring to deploy a movable bullet resistant panel outwardly from a briefcase. Actuation may be by either a push or a pull movement of a user's hand or finger. Push actuation or deployment systems are illustrated in FIGS. 1, 2, 8A, 8B, 11, 12, 13, and 14. A pull actuation or deployment system is illustrated in FIGS. 15 and 16.

A single latch or a double latch may be employed to hold the movable panel against the bias of the deploying or actuating compression spring(s). A single latch is illustrated in FIGS. 3, 8A, 8B, 11, 12, 13, and 14, and a double latch is illustrated in FIGS. 15 and 16.

Either a single or a double latch may be used with either a push or a pull deployment or actuation system.

Note also that a release assembly may be located at any desirable location, such as above the handle 24, as shown in FIG. 1, below the handle 24, as shown in FIG. 3, or within the handle as shown in FIGS. 11 and 15.

While the principles of the invention have been made clear in illustrative embodiments, there will be immediately obvious to those skilled in the art many modifications of structure, arrangement, proportions, the elements, materials, and components used in the practice of the invention and otherwise, which are particularly adapted to specific environments and operative requirements without departing from those principles. The appended claims are intended to cover and embrace any and all such modifications, within the limits only of the true spirit and scope of the invention.

What I claim is:

1. Bullet resistant briefcase apparatus comprising in combination:

a briefcase having a compartment defined by a pair of end walls spaced apart from each other, a bottom wall, a top wall, and a side wall secured to the end walls, the bottom wall, and the top wall, and a cover pivotally secured to the bottom wall;

a first bullet resistant panel disposed in the compartment;

a second bullet resistant panel disposed in the compartment;

telescoping sleeve means, including a first sleeve secured to one of the end walls, and a second sleeve secured to the second bullet resistant panel;

compression spring means including a first compression spring disposed in the first and second sleeves and extendible from a compressed state when the second bullet resistant panel is disposed in the compartment to an extended state for moving the second bullet resistant panel outwardly from the compartment to a deployed position; and release means actable by a user of the apparatus for releasing the compression spring means from the compressed state to the extended state to move the second bullet resistant panel outwardly to its deployed position.

2. The apparatus of claim 1 in which the telescoping sleeve means further includes a third sleeve secured to the one of the end walls spaced apart from the first sleeve, and a fourth sleeve secured to the second bullet resistant panel spaced apart from the second sleeve.

3. The apparatus of claim 2 in which the compression spring means further includes a second compression spring disposed in the third and fourth sleeves.

4. The apparatus of claim 2 in which the release means includes a first latch bracket secured to the second bullet resistant panel, a first release bracket secured to the first and third sleeves, a release slide movable on the first release bracket, a first latch arm on the release slide, a first latch slot on the first latch arm for receiving the first latch bracket to prevent the first compression spring from extending and moving the second bullet resistant panel outwardly, and means for moving the release slide to move the first latch slot away from the first latch bracket to allow the first compression spring to extend from its compressed state to move the second bullet resistant panel outwardly.

5. The apparatus of claim 4 in which the means for moving the release slide includes an extension arm secured to the release slide extending outwardly from the compartment through the top wall.

6. The apparatus of claim 5 in which the briefcase further includes a handle secured to the top wall, and the extension arm is disposed adjacent to the handle.

7. The apparatus of claim 5 in which the release means further includes a release spring biasing the extension arm inwardly toward the compartment for providing a pull movement on the extension arm to move the release slide.

8. The apparatus of claim 7 in which the release spring is a tension spring.

9. The apparatus of claim 5 in which the release means further includes;

a second latch bracket secured to the second bullet resistant panel, a second latch arm on the release slide, and a second latch for receiving the second latch bracket.

10. The apparatus of claim 1 which further includes means for locking the second bullet resistant panel outwardly from the compartment.

11. The apparatus of claim 1 in which the other of the end walls includes an opening through which the second bullet resistant panel moves, and the opening comprises a hand hold for the user of the apparatus when the second bullet resistant panel is deployed outwardly from the compartment.

12. Bullet resistant briefcase apparatus comprising in combination:

a briefcase having a compartment defined by a pair of end walls spaced apart from each other, a bottom wall, a top wall, and a side wall secured to the end walls, the bottom wall, and the top wall, and a cover pivotally secured to the bottom wall;

a first guide channel disposed adjacent to the bottom wall;

a second guide channel disposed adjacent to the top wall;

a fixed bullet resistant panel disposed in the guide channels and adjacent to side wall;

a movable bullet resistant panel disposed in the guide channels adjacent to the fixed bullet resistant panel;

telescoping sleeve means, including an outer sleeve secured to one of the end walls, and an inner sleeve movable in the outer sleeve and secured to the second bullet resistant panel;

compression spring means including a first compression spring disposed in the sleeves and extendable from a compressed state when the second bullet resistant panel is disposed in the compartment to an extended state for moving the second bullet resistant panel outwardly from the compartment to a deployed position; and release means actuable by a user of the apparatus for releasing the compression spring means from the compressed state to the extended state for moving the second bullet resistant panel outwardly to its deployed position.

13. The apparatus of claim 12 in which the telescoping sleeve means further includes another outer sleeve secured to the one of the end walls spaced apart from the first sleeve, and another inner sleeve secured to the movable bullet resistant panel spaced apart from the second sleeve.

14. The apparatus of claim 13 in which the release means includes a first latch bracket secured to the second bullet resistant panel, a first release bracket secured to the outer sleeves, a release slide movable on the first release bracket, a first latch arm on the release slide, a first latch slot on the first latch arm for receiving the first latch bracket to prevent the first compression spring from extending and moving the movable bullet resistant panel outwardly, and means for moving the release slide to move the first latch slot away from the first latch bracket to allow the first compression spring to extend from its compressed state to deploy the movable bullet resistant panel outwardly from the compartment.

15. The apparatus of claim 14 in which the means for moving the release slide includes an extension arm secured to the release slide extending outwardly from the compartment through the top wall and adjacent to a handle secured to the top wall.

16. The apparatus of claim 14 in which the release means further includes;

a second latch bracket secured to the second bullet resistant panel, a second latch arm on the release slide, and a second latch for receiving the second latch bracket.

17. The apparatus of claim 12 in which the other of the end walls includes an opening through which the movable bullet resistant panel moves, and the opening comprises a hand hold for the user of the apparatus when the movable bullet resistant panel is deployed outwardly from the compartment.

18. The apparatus of claim 13 in which the compression spring means further includes a second compression spring disposed in the other inner and outer sleeves to help deploy the movable bullet resistant panel.

* * * * *